US006427562B1

(12) United States Patent
Muhlenkort

(10) Patent No.: US 6,427,562 B1
(45) **Date of Patent: *Aug. 6, 2002**

(54) CHAIN WRENCH

(76) Inventor: Donald F. Muhlenkort, P.O. Box 182, East Grand Forks, MN (US) 56721

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/963,552

(22) Filed: Nov. 3, 1997

(51) Int. Cl.[7] ..... B25B 13/52
(52) U.S. Cl. ..... 81/65.2; 81/3.43
(58) Field of Search ..... 81/65.2, 64, 65, 81/68–70, 65.4, 3.43

(56) References Cited

U.S. PATENT DOCUMENTS 298,442 A * 5/1884 Brock
542,136 A * 7/1895 Booth ..... 81/70
974,019 A * 10/1910 Blackmore ..... 81/70
1,096,377 A * 5/1914 Knapp et al. ..... 81/65.4
2,795,986 A * 6/1957 Petersen
2,825,253 A * 3/1958 Brenner ..... 81/68
3,230,800 A * 1/1966 Yohe ..... 81/65.2
3,314,317 A * 4/1967 Ashley ..... 81/68

FOREIGN PATENT DOCUMENTS

GB 211136 * 9/1925 ..... 81/69

* cited by examiner

*Primary Examiner*—D. S. Meislin

(57) ABSTRACT

The invention comprises a chain wrench having a mounting plate with an elongated link chain with one end of the chain pivotally mounted to the plate and extending outward from the plate one edge of the plate. The plate has a plurality of spaced lugs along an opposing edge of the the plate with the chain having a plurality of spaced pins at intervals along the length of the chain whereby the chain may be wrapped from its one end about a work piece with an having its pins located along its intermediate portion of its length inserted in the spaces between the lugs, whereupon a turning tool may be mounted to the mounting plate to turn the mounting plate relative to the work piece to draw the one end of the chain toward the intermediate portion of the chain, and whereupon the tool may be further turned in the same direction to rotate the mounting plate, chain, and work piece about a center axis of the work piece.

1 Claim, 1 Drawing Sheet

CHAIN WRENCH

This invention relates to chain wrenches, more particularly, the invention relates to chain wrenches for engagement about a work piece for turning the work piece.

It is an object of the invention to provide a novel chain wrench having a chain mounting bar for attachment of one end of the chain thereto for engaging the chain about a work piece which provides a pivotal mounting of the chain to the work piece so that the chain can encircle the work piece more completely including the portion of the work piece in front of the chain mounting for a more effective grasping of the chain to the work piece.

It is a further object of the invention to provide a novel chain wrench having a chain mounting bar with one end of the chain pivotally mounted to the bar for encircling the work piece with a lug at the side of the bar opposite the pivotal mounting for receiving an intermediate portion of the chain after the chain has encircled the work piece with the bar having a turning tool attachment whereby the bar may be rotated to draw the pivotal end of the chain toward the intermediate portion of the chain for tightening the chain about the work piece and rotating the work piece.

Further objects and advantages of the invention will become apparent as the description proceeds and when taken in conjunction with the accompanying drawing wherein:

BRIEF DESCRIPTION OF PREFERRED EMBODIMENT

Briefly stated, the invention comprises a chain wrench having a mounting plate with a link chain having one end pivotally mounted to the plate and with the plate having at least one mounting lug fixed to the plate opposite the edge of the plate to which the chain extends from its pivotal mounting, with said lug being adapted to receive an intermediate link of the chain for securing the intermediate portion of the chain to the plate. The plate has a mounting member for mounting a turning tool to the plate for turning the plate about the axis of the lug mounting of the plate to the intermediate portion of the chain, in a direction to draw the one end of the chain toward the intermediate portion of the chain, for tightening the chain about the work piece to enable further turning of the plate to rotate the work piece.

Figure 1:
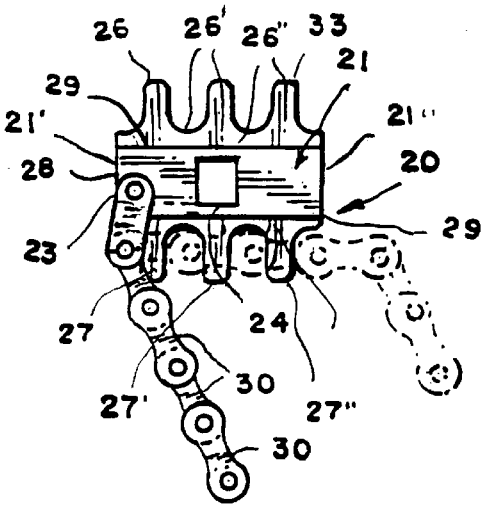
FIG. 1 is a side elevation view of the chain wrench invention.
Figure 2:
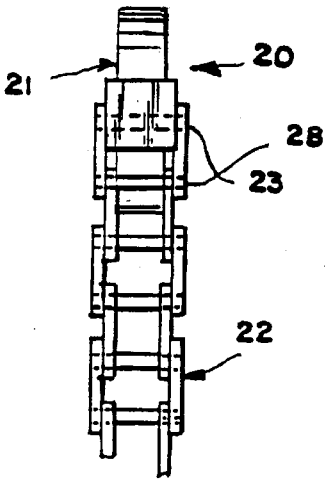
FIG. 2 is an end view of the chain wrench invention.

Referring more particularly to the drawing, in FIG. 1, the wrench chain invention 20 is illustrated having a mounting plate 21 with a link chain 22 having its one end 22' pivotally mounted to the mounting plate by a pin 23, so as to extend away from the one edge 21' of the plate. The mounting plate 21, as shown the drawing, has a generally rectangular compact shape with generally longitudinal opposing surfaces 30 and 31, along generally straight parallel longitudinal paths, and generally laterally opposed surfaces 32 and 33 along generally straight parallel lateral paths. The longitudinal and lateral surfaces 30–33 formed four corners 34–37, where their paths intersect. The mounting plate 21 has a square opening 24 through the plate 21 for receiving a square turning tool to enable the turning tool to rotate the plate 21. The chain 22 is adapted to encircle a circular work piece 25 as shown in the drawing with the mounting plate 21 having a set of three lugs 26,26' and 26" along the longitudinal surface 30 of the plate opposite the direction the chain extends from the plate. The three lugs are spaced from one another along the mounting plate for receiving the pins 28' of the chain linking the chain 22 together in the spaces between the lugs. The mounting plate 21 has a similar set of three lugs 27,27' and 27" fixed to the plate 21 on the longitudinal surfaces or edge 31 of the plate opposite the lugs 26,26', and 26" with the lugs 27–27" also being spaced from one another to enable the pins 28' of the chain 22, adjacent the pivotal mounting of the one end 22' of the chain to the plate, to be received in the open spaces between the lugs. The plate 21 has reduced shoulders 29 so that the lugs have reduced sides to enable the link members 30 of the chain to be received beside the lugs to enable the chain to fit into and along the lugs of the plate 21.

Operation

Figure 3:
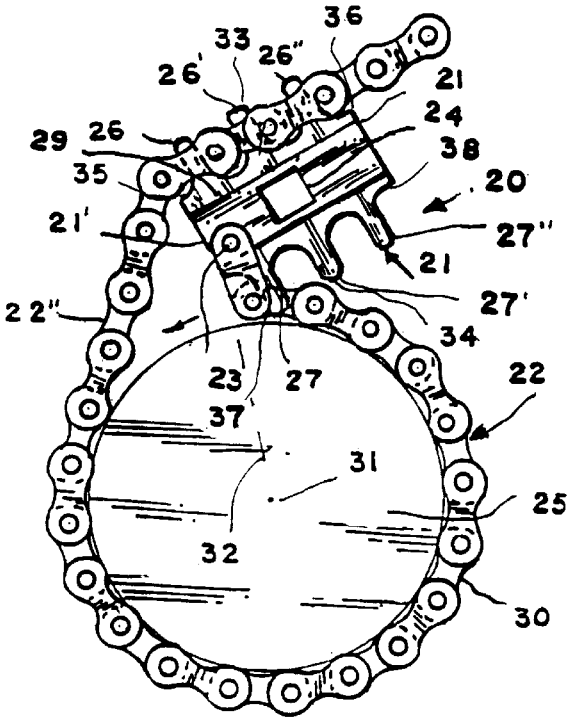
FIG. 3 is a side elevation view of the chain wrench illustrating the wrench wrapped around a work piece for grasping and turning the work piece with the chain wrench.
Figure 4:
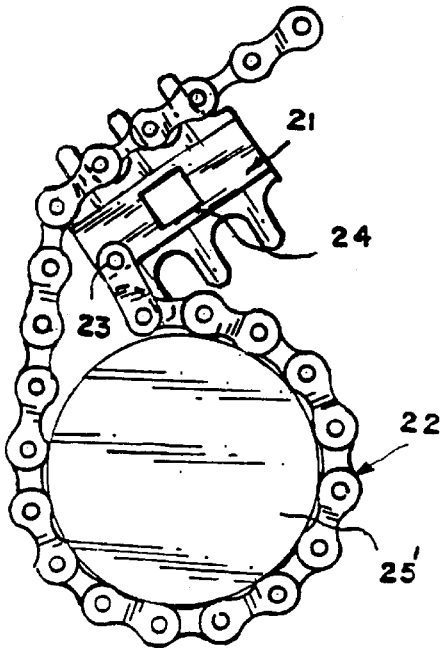
FIG. 4 is a side elevation view of the chain wrench illustrating the chain wrench wrapped around a relatively small work piece for grasping and turning the work piece with the wrench.

The chain wrench invention operates as follows:

The chain wrench invention 20 will be placed with the mounting plate 21 adjacent the work piece 25, as shown in FIG. 3, with the work piece being the larger illustrated work piece of the drawings. The chain 22 will be wrapped around the work piece 25 and an intermediate portion 22" of the chain will be inserted in the spaces between the lugs 26, with the pins 28' of the chain received in the spaces between the lugs as shown in FIG. 3 to lock the intermediate portion of the chain to the plate 21. The mounting plate 21 may be rotated counterclockwise from its position shown in FIG. 3 to facilitate inserting the pins 28' between the lugs 26,26, and 26". Thereafter, the plate may be rotated by a turning tool (not shown)having a square end inserted into the square opening 24 in the mounting plate 21 clockwise, when viewed from FIG. 3, about the lug 26 of the plate 21, with lug 26 serving as a pivot point to draw the one end 22' of the chain pivotally mounted to the mounting plate at the corner 34 of the plate toward the intermediate portion 22" of the chain attached to the lugs 26,26', and 26" pivoting the plate about the first lug 26 clockwise in an arc toward the work piece toward a center line 32 passing through the center axis 31 of the work piece and through the lug 26 to thereby tighten the chain about the work piece 25. Whereupon when the rotating the tool clockwise has tightened the chain about the work piece, the operator will continue to rotate the mounting plate clockwise with the turning tool with the continued rotating of the turning tool turning the work piece 25 clockwise about its center axis 31. The chain wrench 20 may also be used to rotate a smaller work piece 25' shown in FIG. 4, when a shorter length of the chain being required to encircle the work piece, with the mounting plate being rotated clockwise with a turning tool in a similar manner as described with reference to the turning of the work piece in FIG. 3.

The various parts or portions of the chain 22 as shown in the drawings may be referred to as follows: The portion of the chain 22 where attached to the plate by pin 23 may be referred to as the one end of the chain. The portion of the chain 22 extending about the object 25 may be referred to as the first intermediate portion of the chain. The portion of the chain 22 extending from the object diagonally toward the rear side and lugs 26–26" of the plate may be referred to as the second intermediate portion of the chain, and the portion of the chain extending along and engagable to the lugs 26–26' may be referred to as the other remote end of the chain.

Thus, it will be seen that a novel chain wrench has been provided that will enable a chain to be more completely encircled about the work piece and more tightly wrapped about the work piece with the pivotal mounting of the chain to the plate enabling a wedging action of the one end of the chain along clockwise in toward the work piece about the axis of the lug 26 relative to the mounting plate 21, as the mounting plate is rotated clockwise as indicated by the arrow 34 about the opening 24, while the continued rotation of the plate with the plate wedged or locked to the work piece, will rotate the entire mounting plate, chain, and turning tool clockwise about the center axis 31 of the work piece 25, when viewed from FIG. 3, to rotate the work piece for such things as tightening and loosening the work piece relative to its mounting or some other object. While the mounting plate 23 will pivot about the lug 26, when viewed from FIG. 3, toward the center line, the lug 27 at the corner 34 of the plate will engage against a pin 28' at one end 22' of the chain to cause the one end 22' of the chain to pivot in an arc inward toward the work piece and toward the center line 32 about the tooth 26 in a wedging locking action as indicated by arrow 35 to tighten and lock the chain to the work piece. The plate will not pivot clockwise past the center line before locking. If it does pivot past the center line 32, then the plate needs to be adjusted by pivoting the plate counterclockwise to place the lugs 26,26', and 26" of the plate one link pin further left in the pins 28', when viewed from FIG. 3, to shorten the length of the chain about the work piece, and then pivot the plate, with the turning tool, clockwise about the lug 26 until the one end 22' of the chain wedges against the work piece and locks to the work piece just before passing the center line 32.

Whether the tool is used in conjunction with tuning a large object 25 or a smaller object 25', the plate 21 must be adjusted into an appropriate link pin of the chain so as not to pass the center line 32 when pivoting the plate clockwise to lock the plate to the work piece, so that further turning of the plate clockwise after the locking action will not move the one end 22' of the chain relative to the work piece, but will rotate the plate, chain, and work piece clockwise about the center axis 31 of the work piece, as or while the plate remains locked to the work piece thereby rotating the work piece about its threaded mounting to the work piece support (not shown).

It will be obvious that various changes and departures may be made to the invention without departing from the spirit and scope thereof, and accordingly, it is not intended that the invention be limited to that specifically described in the specification or as illustrated in the drawing, but only as set forth in the appended claims wherein:

What is claimed is:

1. A chain wrench for turning a circular object about a center axis of the object comprising, a rectangular plate formed of a first pair of opposing longitudinal outer surfaces extending along parallel longitudinal paths and a second pair of opposing laterally extending outer surfaces extending along parallel lateral paths which are lateral to said first pair of longitudinal surfaces, said longitudinal and lateral surfaces having end portions connected together to form four corners of said plate where said end portions intersect;

an elongated chain having remote ends and consecutive intermediate portions, said chain having one of its remote ends connected to said plate at one of said corners formed by one of said longitudinal and one of said lateral surfaces;

said plate having a plurality of lugs formed on each of said longitudinal surfaces of said plate;

said plate having a square opening for receiving a tool to be turned by the tool;

wherein, said chain is receivable about an object and said plate is rotated by a tool such that the object is turned thereby.

* * * * *